United States Patent [19]

Wier

[11] 4,393,553

[45] Jul. 19, 1983

[54] LOCKING DEVICE FOR A SAFETY BELT

[75] Inventor: Franz Wier, Göggingen, Fed. Rep. of Germany

[73] Assignee: Repa Feinstanzwerk GmbH, Alfdorf, Fed. Rep. of Germany

[21] Appl. No.: 237,921

[22] Filed: Feb. 25, 1981

[30] Foreign Application Priority Data

Feb. 25, 1980 [DE] Fed. Rep. of Germany ..... 3006939

[51] Int. Cl.[3] ..... A44B 11/25

[52] U.S. Cl. ..... 24/230 AL

[58] Field of Search ..... 24/230 A, 230 AL, 230 AT

[56] References Cited

U.S. PATENT DOCUMENTS 4,137,611 2/1979 Lindblad ..... 24/230 AL

*Primary Examiner*—Hugh R. Chamblee

*Attorney, Agent, or Firm*—Herbert L. Lerner; Laurence A. Greenberg

[57] ABSTRACT

Locking device for a safety belt having a belt lock into which a plug-in tongue can be inserted and be locked by at least one locking latch. The locking latch can be moved by a manual pressure element transversely to the plug-in guide from the locked position into the open position. A spring-activated sliding ejector is disposed within the plug-in guide. A stop which can be moved into the slide path of the ejector acts in conjunction with the pressure element. The stop blocks the ejector in a position a short distance from contact with the locked plug-in tongue. The ejector is released by moving the pressure element into the opening position.

5 Claims, 6 Drawing Figures

LOCKING DEVICE FOR A SAFETY BELT

BACKGROUND OF THE INVENTION

1. Field of the Invention

The invention relates to a locking device for a safety belt having a belt lock into which a plug-in tongue can be inserted and be locked by at least one locking latch. The locking latch can be moved by a manual pressure element transversely to the plug-in guide from the locked position to the open position. A spring-activated, sliding ejector is disposed in the plug-in guide.

2. Description of the Prior Art

In the known belt locks for safety belts, the locking latch, required for locking the plug-in tongue which is connected with the free belt end of the safety system, can slide perpendicularly to the insertion path of the plug-in tongue against the force of a spring into an opening position by the operation of a pressure element, as for example, a pressure button. After the plug-in tongue has been pulled out, the locking latch falls back into the lock position again. A so-called ejector which moves in the direction of the plug-in path against a spring force thereby comes in contact with the forward end of the inserted tongue, and is pressed back, whereby tension is stored in the spring. In the locked position of the plug-in tongue, the ejector presses with a certain force onto the tongue, so that, after the locking latch has been manually moved to the opening position, the pretensioned ejector ejects the plug-in tongue from the belt lock, and in some cases retains the locking latch in the opening position thereafter.

In this locking system wherein the locking edge of the plug-in tongue is always pressed against the locking latch with a certain force, the danger exists that the motion of the locking latch to the opening position is inhibited to a considerable extent by the mentioned pressure force of the ejector, and which force the tongue also presses onto the locking latch. The danger even exists that this motion may be blocked or prevented by the high friction, occurring particularly for example, at rounded edges of the plug-in tongue and the locking latch, so that the ejection of the tongue is obstructed or even prevented. The consequence of the locking device failing to open may be severe in the case of a crash, when the person using the safety device is exposed to an immediate danger in the damaged vehicle and should be capable of freeing himself from the vehicle without delay, or be removed from there by the rescue service.

SUMMARY OF THE INVENTION

An object of the instant invention is to provide a locking device of the mentioned type, which will operate with assurance that the motion of the locking device to the opening position is not obstructed or inhibited.

With the foregoing and other objects in view, there is provided in accordance with the invention a locking device for a safety belt comprising a belt lock having two spaced plates defining an insertion path, a plug-in tongue attached to a belt for insertion in the insertion path, a latch movable transversely to the direction of insertion of the plug-in tongue to detent the inserted tongue, a pressure element movable manually against the force of a spring to move the latch transversely out of the detent position, a spring-activated sliding ejector disposed in the insertion path ahead of the tongue, a stop connected with the pressure element to halt the ejector from contacting the tongue when in the detent position, said stop movable with the pressure element and concurrently moves away from blocking said ejector when said pressure element moves said latch out of the detent position.

Other features which are considered as characteristic for the invention are set forth in the appended claims.

Although the invention is illustrated and described herein as embodied in a locking device for a safety belt, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which.

Figure 3:
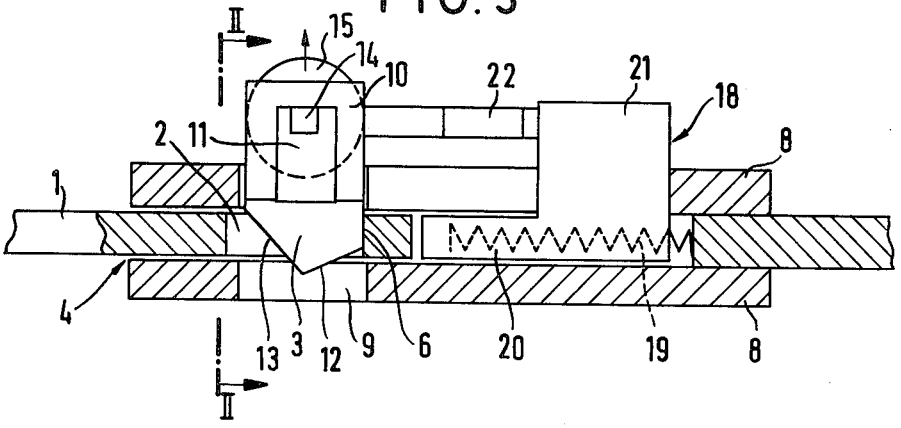

FIG. 3 schematically illustrates a median, longitudinal section of the locking device of the invention and, in particular, shows the relationship between the plug-in tongue, the insertion path in the lock, the locking latch, the pressure element, the ejector, the stop, and the coaction of the pressure element, ejector and stop.

Figure 4:
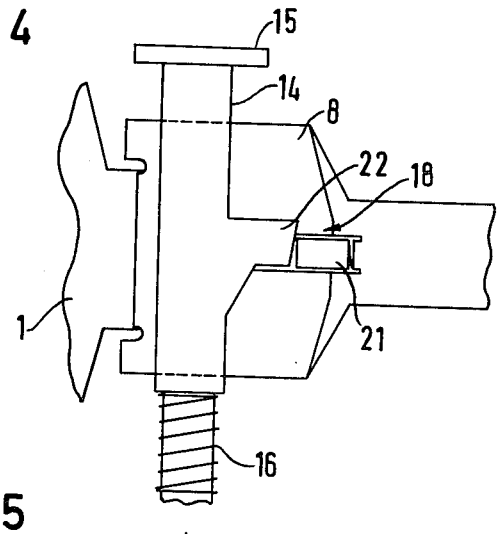
Figure 5:
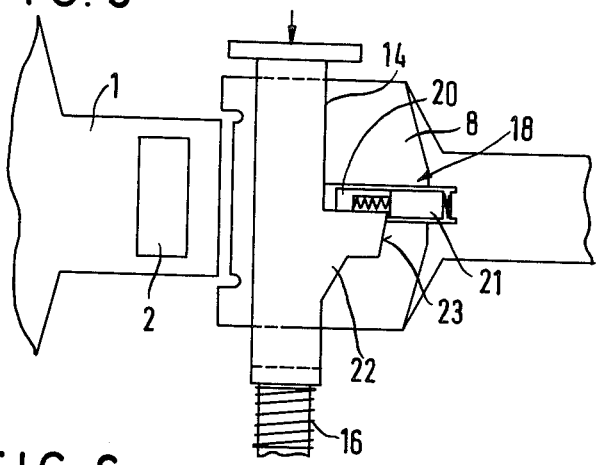
Figure 6:
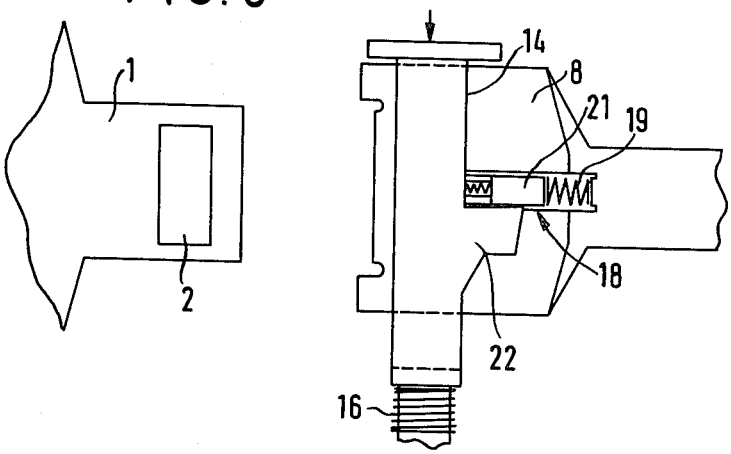

FIGS. 4, 5 and 6 diagrammatically show the locking device according to the invention in three different operating positions. In FIG. 4, with the pressure element in normal rest position, a stop attached to the pressure element blocks the ejector from contacting the forward end of the tongue. In FIG. 5, the pressure element is moved a part distance but the ejector remains blocked. In FIG. 6, the pressure element is moved its entire distance and only then is the ejector unblocked.

DETAILED DESCRIPTION OF THE INVENTION

A stop which can be moved into the slide path of the ejector acts in conjunction with the pressure element. The stop blocks the ejector in a position in which it does not touch the locked plug-in tongue. Moving the pressure element into the open position also moves the stop to release the ejector from its blocked position. Despite the fact that the ejector is under tension while the inserted tongue is in the locked position and also during unlocking, nevertheless this tension does not bear on the locking latch through the locking edge of the tongue, either directly or indirectly, and thus a complete or partial blocking between these two parts is not possible. Under these conditions the locking latch can be moved without interference by the pressure element to a position where it releases the plug-in tongue, or to a position where the locking latch, which is provided with a slanted run-up surface, for example, can be moved by the released ejector into the opening position. Preferably, the release of the ejector occurs only if the locking latch is in the opening position, or in a position in which it is automatically moved to the opening position by the tongue. In an advantageous construction of the locking device according to the invention, the stop which is connected with the pressure element is provided with a support surface for the ejector which is slanted with respect to the direction of its motion, whereby the pressure element is pressed into the non-operative position by the force of the ejector.

Further advantageous details of the invention are explained in the typical embodiment shown in the drawings and described in the following.

Figure 1:
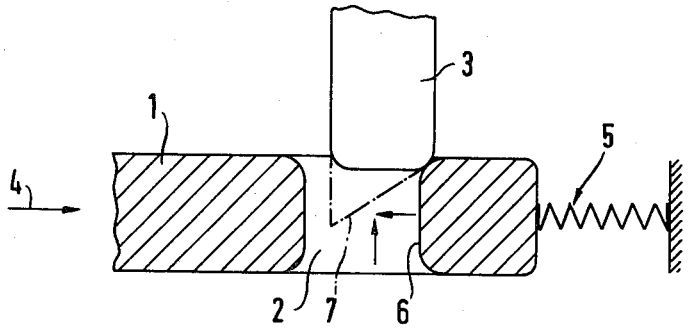
FIG. 1 is a schematic representation of a partial block between a plug-in tongue and a locking latch in a known safety system.

In the schematic diagram in FIG. 1, the problem is shown which is solved by the locking device according to the invention. A plug-in tongue 1, is fastened at the free end of the belt of a safety system. The tongue 1 is provided in the region of its free, forward end with a detention opening 2 into which a locking latch 3 engages, after the plug-in tongue has been inserted in the belt lock, not shown further. The locking latch 3 is supported so that it can slide transversely to the plug-in guide 4 of the tongue 1. An ejector 5 is schematically shown as a spring. The plug-in tongue 1 is inserted into the plug-in guide 4 of the tongue 1 to its locked position against this spring force, thereby tensioning the spring of the ejector 5, and pressing the locking edge 6 of the plug-in tongue 1 with a certain force against the locking latch 3. To open the locking device, the locking latch 3 is manually moved by a pressure element, not shown, until the locking latch 3 is located outside of the plug-in guide 4, or until the locking edge 6 moves up on a slanted surface 7 of the locking latch 3 to the upper corner, FIG. 1, and automatically presses the latch outside of the plug-in guide 4 by the force of the ejector 5. However, the danger exists that the locking latch 3 is blocked even before it is outside of the plug-in guide 4, especially when rounded edges between tongue 1 and locking latch 3 increase the friction between these elements.

Figure 2:
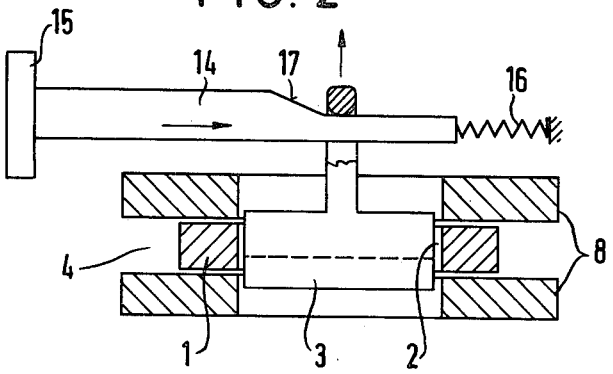
FIG. 2 is a schematic representation of the locking device according to the invention taken along line II—II of FIG. 3.

In the typical embodiment according to FIGS. 2 and 3, two plates 8 which are parallel to each other and form the basic body of the belt lock define the boundaries of the plug-in guide 4. The plug-in tongue 1 can be inserted into the plug-in guide 4. The locking latch 3 is supported in the openings 9 of the plates 8, and can slide in the direction of the arrow. The locking latch 3 is provided with a hump-shaped projection 10 which has an opening 11 and at its locking, free end two slide surfaces 12 and 13 which slant in directions opposite to each other.

In FIGS. 2 and 3, the plug-in tongue 1 is inserted in the belt lock, and the locking latch 3 is engaged in position. The vertical latch portion adjacent to the slide surface 12 butts against the locking edge 6 of the tongue 1, and blocks its withdrawal path. A pressure element 14, in the form of a pressure key, is provided with an operating button 15, and is supported in the belt lock above plate 8 to enable sliding it against the force of spring 16. By sliding the pressure element 14 in the direction of the arrow, FIG. 2, a slanted surface 17 moves up at the upper end of the projection 10, and thereby, moves the locking latch 3 upward a distance. As a result, the locking edge 6 of the tongue 1 contacts the slide surface 12 of the locking latch 3, and presses the latter into the open position outside of the plug-in guide 4, so that the plug-in tongue 1 can be pulled out of the belt lock. An ejector designated generally by 18, is provided with an ejector-projection 20 which is slideable in the plug-in guide 4 by the force of a spring 19, and has a push-projection 21 which, as shown in FIG. 3, extends above the upper plate 8. The pressure element 14 has a stop 22 which extends to the side. In the locked position, the push-projection 21 of the ejector 18 butts against the stop 22. The ejector projection 20 is arranged to be spaced a short distance, for example an eighth of an inch or less, from the free end of the plug-in tongue 1, and does not come in contact with it. However, if the pressure element 14 is operated, by the motion of the pressure element, the stop 22 comes out of engagement with the push-projection 21, so that the ejector is freed, and pressed by the spring 19 against the tongue 1, and ejects the latter from the belt lock.

The functioning of the locking device is explained with the aid of FIGS. 4, 5 and 6. In FIG. 4, the plug-in tongue 1, corresponding to FIGS. 2 and 3, is locked by the locking latch 3. The pressure element 14 is in the non-operative position, so that the stop 22 blocks the slide-path of the ejector 18. The push-projection 21 of ejector 18 contacts slanted support surface 23 of the stop 22, urging the pressure element 14 in its rest position. By manually sliding the pressure element 14 in the direction of the arrow with sufficient force to overcome the urging of spring pressure to next position, the locking latch 3 is moved to the opening position. During this motion of the locking latch 3, the ejector 18 is still blocked by the stop 22, as shown in FIG. 5. Only after the locking latch 3 is located completely outside the plug-in guide 4 of the belt lock, or if the locking edge 6 of the tongue 1 can run up on the slide surface 12 of the locking latch 3, is the ejector 18 released and moves into the position shown in FIG. 6, whereby the stop 22 contacts the push-projection 21 of the ejector 18 with its surface.

The ejector 18 by means of its ejector projection 20 presses the plug-in tongue 1 to move the latter outside of the plug-in guide 4.

I claim:

1. Locking device for a safety belt comprising a belt lock having two spaced plates defining an insertion path, a plug-in tongue attached to a belt for insertion in the insertion path, a latch movable transversely to the direction of the insertion of the plug-in tongue to detent the inserted tongue, a pressure element movable manually against the force of a spring to move the latch transversely out of the detent position, a spring-activated sliding ejector disposed in the insertion path ahead of the tongue, a stop connected with the pressure element to halt the ejector from contacting the tongue when in the detent position, said stop movable with the pressure element and concurrently moves away from blocking said ejector when said pressure element moves said latch out of the detent position.

2. Locking device according to claim 1, wherein the stop is a projection of the pressure element.

3. Locking device according to claim 2, wherein the stop together with the pressure element are movable transversely to the slide path of the plug-in tongue and of the ejector.

4. Locking device according to claim 3, wherein said stop has a support surface for contact with said ejector, which surface is slanted with respect to the direction of its motion, whereby the pressure element is urged into the non-operative position by the force of the ejector.

5. Locking device according to claim 2 or claim 3 or claim 4, wherein the locking path between the stop and the ejector is of sufficient distance to prevent release of the ejector until the locking latch is in the opening position.

* * * * *